US005988077A

United States Patent [19]

Balderi

[11] Patent Number: 5,988,077

[45] Date of Patent: Nov. 23, 1999

[54] CONVERTIBLE TABLE LEG APPARATUS

[75] Inventor: Nicola Balderi, Kansas City, Mo.

[73] Assignee: Jofco Incorporated, Jasper, Ind.

[21] Appl. No.: 09/207,875

[22] Filed: Dec. 8, 1998

[51] Int. Cl.[6] ..... A47B 57/00

[52] U.S. Cl. ..... 108/64; 248/188

[58] Field of Search ..... 108/59, 64, 65, 108/69; 248/188, 188.1

[56] References Cited

U.S. PATENT DOCUMENTS

| | | | |
|---|---|---|---|
| 2,053,659 | 9/1936 | Gisser . | |
| 3,136,517 | 6/1964 | Gariepy | 248/188 |
| 4,102,587 | 7/1978 | Herb et al. | 248/188 X |
| 4,290,710 | 9/1981 | Waller . | |
| 4,366,758 | 1/1983 | Brecher | 108/64 |
| 4,665,836 | 5/1987 | Burr . | |
| 4,735,151 | 4/1988 | Bishing | 108/69 |
| 5,035,186 | 7/1991 | Uredat et al. | 108/64 X |
| 5,182,996 | 2/1993 | Gutgsell | 108/64 |
| 5,232,303 | 8/1993 | Rubner . | |
| 5,341,749 | 8/1994 | Noakes . | |
| 5,435,254 | 7/1995 | Amey et al. | 108/64 |
| 5,528,996 | 6/1996 | Edwards et al. . | |
| 5,560,302 | 10/1996 | Diffrient et al. | 108/64 |
| 5,794,545 | 8/1998 | McDaniel et al. . | |

*Primary Examiner*—Peter M. Cuomo
*Assistant Examiner*—Hanh V. Tran
*Attorney, Agent, or Firm*—Baker & Daniels

[57] ABSTRACT

A convertible leg apparatus is provided for use with articles of furniture, such as for supporting two tables in abutting relation. The apparatus preferably includes a double-post leg assembly mounted to a plate. The plate defines a pair of parallel slots, each elongated along parallel axes, and a pair of apertures spaced apart from an end of each slot and aligned along the corresponding axis of the slot. The slots and apertures are sized to receive an elongated fastener therethrough. The underside of each tabletop includes a plurality of fastener bores, each of the bores being aligned with one of the pair of slots or pair of apertures. Elongated fasteners, such as thumbscrews, extend through the slots and apertures for engagement within threaded bores aligned therewith. The convertible leg apparatus can be engaged at each end of a tabletop, and optimally at the joint between the abutting tabletops. The parallel slots in the plate of the convertible leg apparatus allows the plate to slide between a first position solely underneath one table, to a second position spanning the adjacent tabletops. In the second position, the parallel slots are aligned with the fastener bores in one tabletop, while the pair of apertures are aligned with outboard fastener bores in the abutting second tabletop.

11 Claims, 6 Drawing Sheets

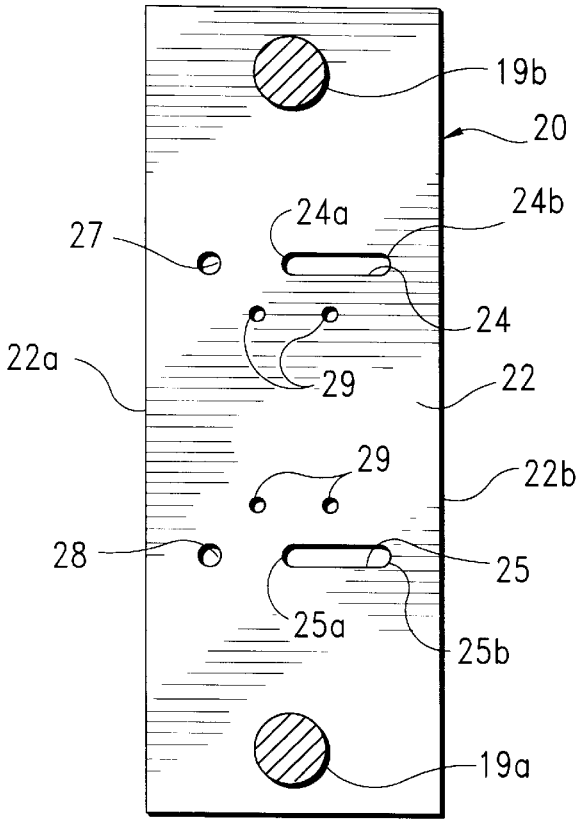
Fig. 4
Fig. 5
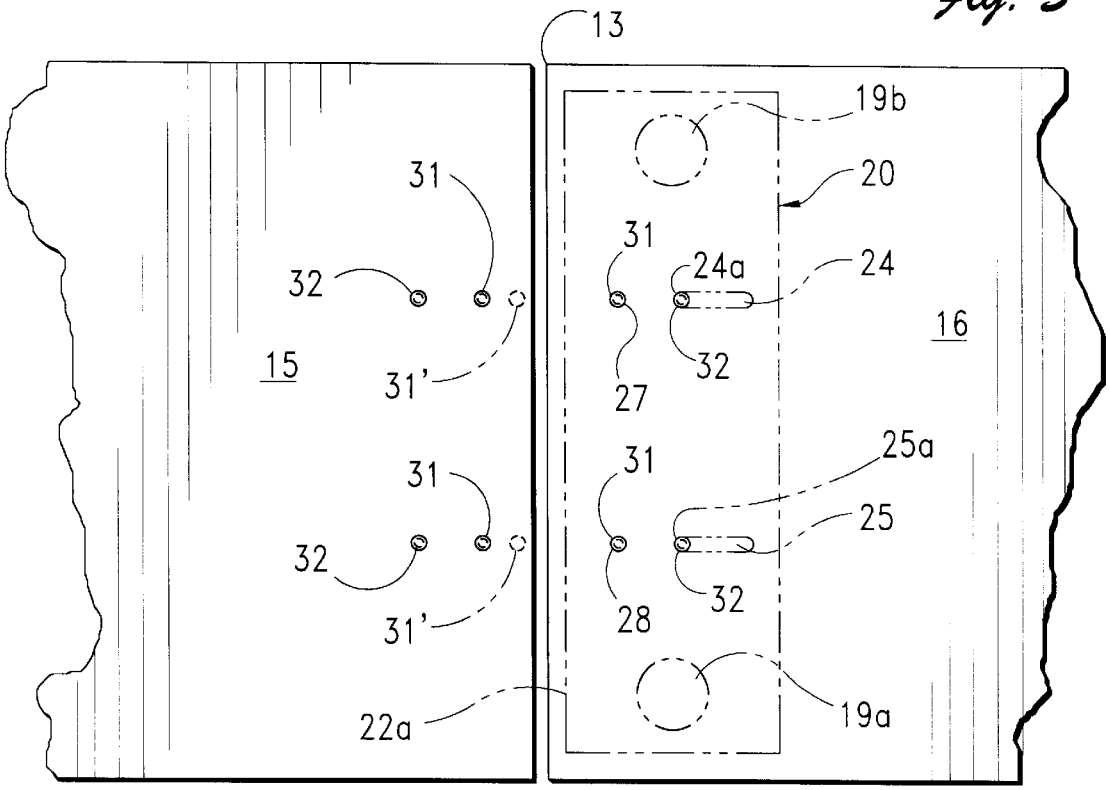

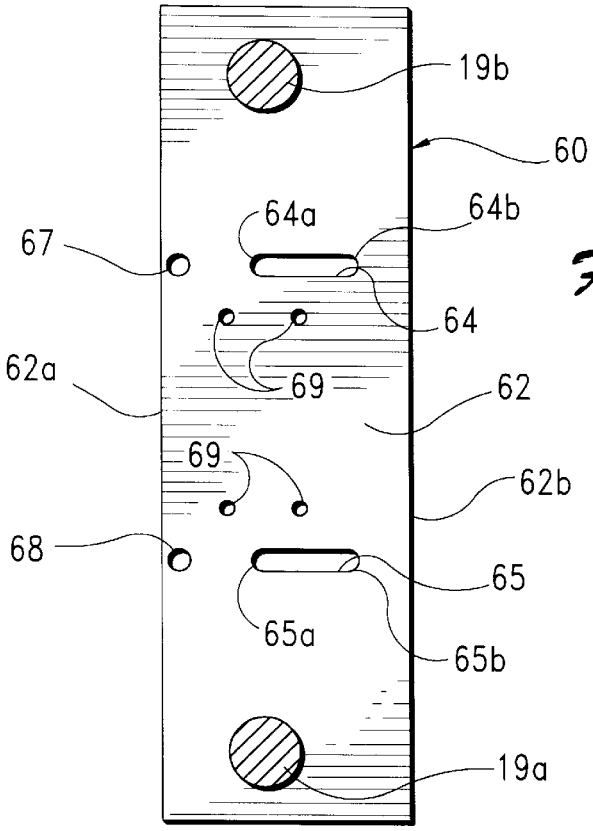
Fig. 8
Fig. 9
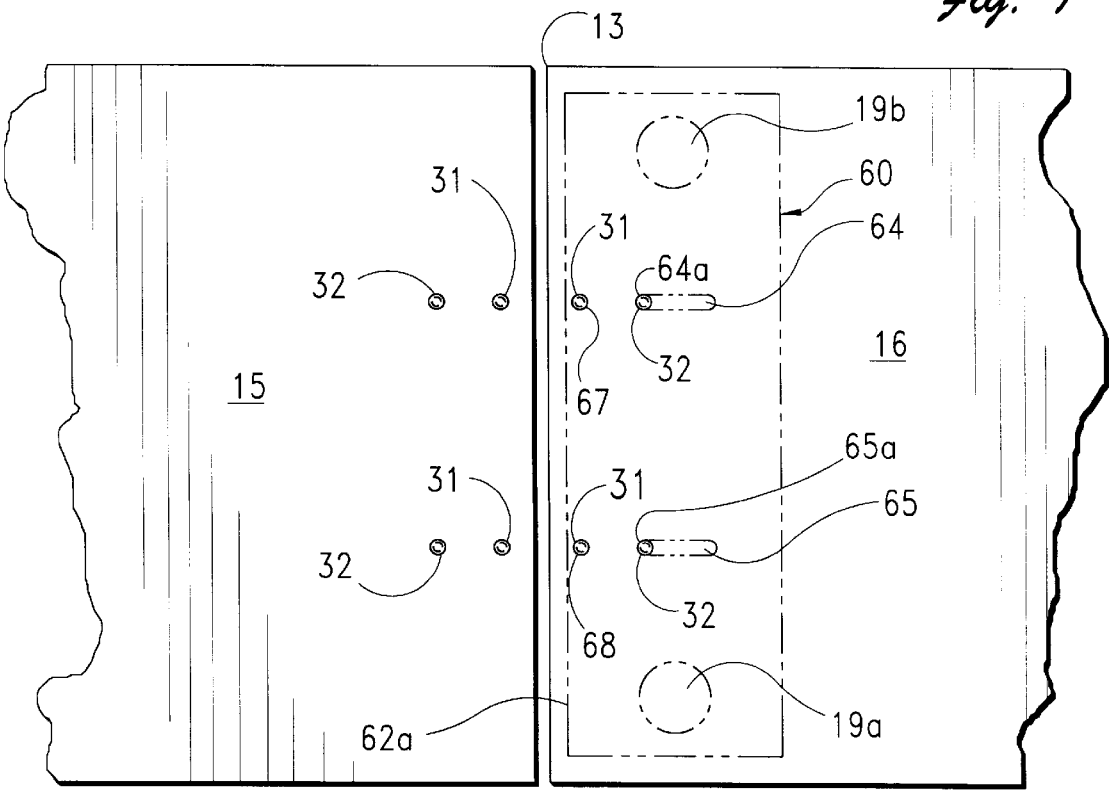

CONVERTIBLE TABLE LEG APPARATUS

BACKGROUND OF THE INVENTION

The present invention concerns a table leg apparatus that is convertible between a position underneath and supporting a single article of furniture, such as a table, to a position capable of supporting two adjacent articles.

The needs of modern office layout design have dictated the design of the office furniture components. One important feature for these office furniture components is modularity. Elements of modular office furniture can be mixed and matched, and combined into a variety of configurations. For instance, a modular table system can be arranged into a variety of table configurations for use as a small conference table, a large meeting table, or a training center. With a typical modular furniture system, several interchangeable components are provided that can be stored when not in use and that can be interconnected to form the variety of layouts.

Most modular furniture elements have small mechanisms for connecting adjacent elements. For example, various table ganging plates have been made available to directly connect existing "stand alone" tables. For example, the metal fastening plate of Waller, shown in U.S. Pat. No. 4,290,710, is a plate that is directly fastened to adjacent tables. In a refinement of that general concept, the patent to Burr, U.S. Pat. No. 4,665,836, shows a table interconnecting apparatus in which a plate is slidable from a position underneath one table to a position interconnecting two adjacent tables.

While the Waller and Burr plates permit interconnection of furniture elements, the elements themselves must be "stand alone" units. In other words, each of a pair of tables ganged together using either one of these prior devices must have its own full complement of table legs.

In order to enhance the modularity of office furniture elements, it has been found desirable to reduce the number of support legs for some of the modular elements. Reducing the number of support legs not only increases the versatility of a modular system it also reduces the storage requirements for those elements. In one approach, a modular table includes removable table legs that can be connected solely beneath a single table, or can be connected to span between adjacent tables. U.S. Pat. Nos. 5,232,303 and 5,528,996 show two such interconnecting table legs. In both cases, the table legs are "plugged into" fixtures mounted within the underside of the adjacent tables. As disclosed in these two patents, each table leg is configured to be plugged into a single fixture in one table, or into portions of two fixtures in adjacent tables.

In another approach, a table leg is mounted to a plate that is pivoted or rotated between its operating positions. Examples of this approach are shown in the patent of Noakes, U.S. Pat. No. 5,341,749, and McDaniel et. al., U.S. Pat. No. 5,794,545. In both cases, an individual table leg is affixed to a plate that is pivoted about a single point. The plate, and therefore the table leg, can assume a position directly underneath one table, or can be pivoted to a position in which the plate and the leg span the joint between the adjacent tables.

One principal drawback with the swinging or rotating plate approach of the '545 and '749 patents is that several of the fasteners used to attach the plates to the tabletops must be removed, leaving a single fastener about which the leg assembly is pivoted. A further determent of this approach is that the action of pivoting the table legs is physically awkward and requires the user to be able to manipulate the leg assembly while underneath the tables.

A further problem with these prior approaches is that the rotating or pivoting concept only works for a single table leg extended from the rotated plate. For stability, many modular furniture elements require a double leg assembly. A double leg assembly includes a pair of leg posts affixed to a single plate, with each leg post having floor engaging elements, such as glides or casters. Typically, the double post leg assembly will also include a horizontal bar spanning between the two leg posts near the base of the legs. The resulting "H" shape of the double post leg has been found to provide greater stability to the table then a traditional single post, "T" shaped leg.

Consequently, there remains a need for a table leg apparatus that can be converted for use with a single table or between adjacent interconnected tables. There is further a need for such an apparatus that can accommodate a double post leg configuration.

SUMMARY OF THE INVENTION

To address these problems of prior art devices, the present invention contemplates a convertible leg apparatus for use with articles of furniture. Most particularly, the convertible leg apparatus is used for supporting one or two tables, such as conference tables.

In one aspect of the invention, the apparatus includes a leg assembly mounted to a plate. The plate defines a pair of parallel slots, each elongated along parallel axes. The plate also defines a pair of apertures spaced apart from an end of each slot and aligned along the corresponding axis of the slot. The slots and apertures are sized to receive an elongated fastener therethrough.

To accommodate the plate of the inventive apparatus, the underside of a tabletop includes a plurality of fastener bores, each of the bores being aligned with one of the pair of slots or pair of apertures. In one embodiment, the elongated fastener is a threaded fastener, and the bores in the tabletop are threaded bores for engaging the fasteners.

The fasteners can be tightened against the plate to fix the plate to the underside of the tabletop. A convertible leg apparatus can be engaged at each end of the tabletop, thereby providing a full complement of legs for supporting the tabletop. In one feature of the invention, the leg apparatus includes a double post leg, having an "H" shape. In this instance, the plate of the convertible leg apparatus is elongated and spans a substantial portion of the width of the tabletop. A single table, then, can include two convertible leg apparatuses, one at each end. In an alternative approach, a single post leg is affixed to the plate, with at least three such single post legs and associated apparatuses supporting the tabletop.

In one aspect of the present invention, a modular table system includes a plurality of tables, each having a like pattern of fastener bores at the ends of the tabletops. The pattern of fastener bores is configured to receive the aforementioned fasteners to engage a corresponding convertible leg apparatus thereto. While each table can include a leg apparatus at each end, the present invention allows two adjacent tables to be supported by a minimum of three convertible leg apparatuses. In this aspect, one leg apparatus is configured to span the joint between adjacent abutting tables. The opposite free ends of each table includes its own leg apparatus.

In accordance with the present invention, the elongated parallel slots in the plate of the convertible leg apparatus allows the plate to slide between a first position solely underneath one table, to a second position spanning the adjacent tabletops. In the second position, the parallel slots are aligned with the fastener bores in a first table, while the pair of apertures are aligned with outboard fastener bores in the abutting second table.

In one embodiment of the invention, the convertible leg apparatus can be easily translated from its first position to its second position. Features of certain embodiments achieve this translation by removing the fasteners extending through the apertures in the plate, while only loosening the fasteners extending through the parallel slots. When the plate is disposed beneath a single tabletop, the fasteners are adjacent the outboard end of each slot, or the end of the slot closest to the apertures. When the plate is translated to its second position spanning the table joint, the fasteners are situates at the opposite, or inboard, end of the slot. In certain embodiments, the outboard end of the slots can be aligned with the outboard fastener bores of the first table to receive an additional set of fasteners.

When the plate of the convertible leg apparatus is translated outboard from the first table, the pair of apertures can be aligned with the outboard fastener bores of the adjacent table. The position of the apertures and bores can be arranged to maintain a tight abutting relationship between the two table tops.

In the preferred embodiments, the convertible leg apparatus includes a double post leg. In these embodiments, the parallel slots and apertures are inboard of the leg posts. In an alternative, the apparatus can accommodate a single post leg. In this alternative embodiment, the parallel slots preferably straddle the single leg post.

In another aspect of certain embodiments of the invention, the slots and apertures in the plate of the leg apparatus and the fastener bores in the tabletops can be arranged so that the leg post(s) are directly beneath the joint between the adjacent tables. In alternative embodiments, the slots, apertures and bores can be arranged so that the leg post(s) are retained beneath the first table, and do not overlap the table joint. In this alternative, the position of the leg post(s) provide greater space beneath the second table.

In a further embodiment of the invention, the plate of the convertible leg apparatus integrates the slot and aperture into one slot. In this embodiment, the plate includes a pair of parallel slots that extend to the edge of the plate. The slots have an inboard closed end and an open end at the plate edge. With this embodiment, the fasteners on the first table need only be loosened, rather than removed. With the fasteners on the first table loosened, the plate can be translated toward the second abutting table. With the slots align with the outboard fastener bores on the second table, additional fasteners can be used to fix the plate to the table. The interconnection of the tables is completed by tightening the fasteners extending through the parallel slots. With this embodiment, each slot can receive three fasteners, two in the first table and one in the second.

It is one object of the present invention to provide a convertible leg apparatus for use with articles of furniture to be interconnected. A further object is accomplished by features of the invention that allow the convertible apparatus to be translated, rather than rotated, between its first and second positions.

One benefit of certain embodiments of the invention is that a single leg assembly can be provided to support abutting ends of two adjacent tables. A further benefit is that the convertible leg apparatus can be readily moved between its operating positions with manipulation of a minimum number of components.

Other objects and benefits of the invention can be discerned from the following written description of the preferred embodiments, together with the accompanying figures.

DESCRIPTION OF THE FIGURES

FIG. 4 is a top elevational view of an attachment assembly forming the convertible table leg apparatus in accordance with one embodiment of the present invention.

FIG. 5 is a view from underneath the table combination illustrated in FIGS. 1 and 2, with the attachment assembly depicted in FIG. 1 shown in phantom lines in its position directly underneath a single table.

FIG. 8 is a top elevational view of an attachment assembly of a second embodiment of the invention for use with a single post table leg.

FIG. 9 is a view from the underside of a table combination as shown in FIGS. 1 and 2, with an attachment assembly according to a further embodiment of the convertible table leg apparatus of the present invention, with the attachment assembly shown in phantom in its first position under only one of the tables.

DESCRIPTION OF THE PREFERRED EMBODIMENTS

Figure 1:
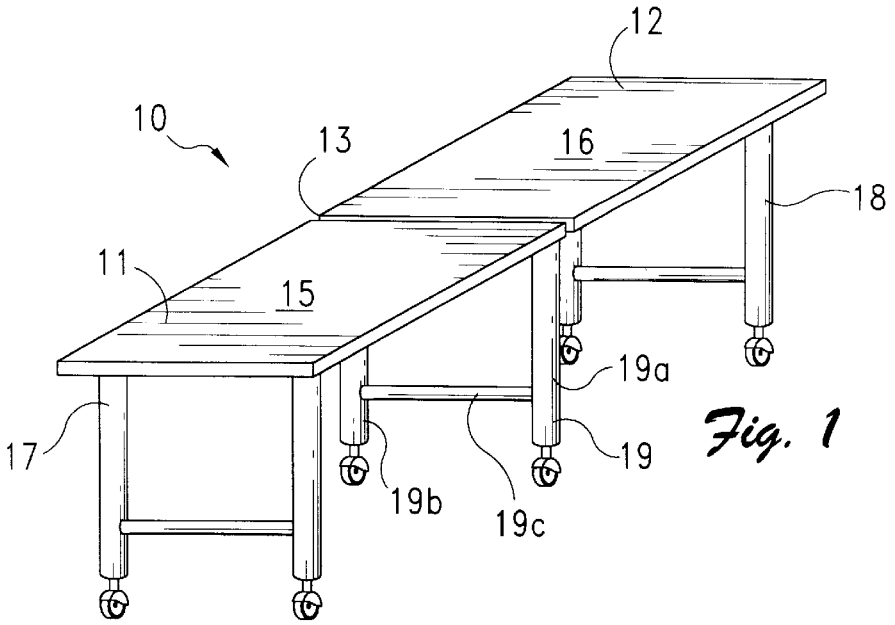
FIG. 1 is a top perspective view of a modular table combination utilizing the convertible table leg apparatus of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated embodiments, and such further applications of the principles of the invention as illustrated therein being contemplated as would normally occur to one skilled in the art to which the invention relates.

The present invention concerns modular furniture, and particularly a convertible leg apparatus that can be translated between two positions. In a first position, the convertible leg apparatus is supporting a single article of furniture. In a second position, the apparatus is extended between adjacent articles to provide support for both articles. It is understood that in accordance with the description of the preferred embodiments that the modular furniture is a table, such as a conference table; however, the same principles can be applied to other types of furniture, particularly office furniture.

Referring to FIG. 1, a table combination 10 is depicted that includes a first table 11 and a second table 12. The tables are interconnected, and preferably abutting, at a joint 13 between the end edges of the two tables. With this interconnection, the two tabletops 15 and 16, respectively, can present a generally smooth uninterrupted surface. In accordance with one aspect of the present invention, the convertible leg assembly allows the two tables 11 and 12 of the combination 10 to be supported by only three leg assemblies. As shown in FIG. 1, the free end of table 11 is supported by an outer leg assembly 17, while the free end of table 12 is supported by an outer leg assembly 18. A common convertible leg assembly 19 is situated at the joint 13 between the two tables, thereby providing simultaneous support for both tables.

Figure 2:
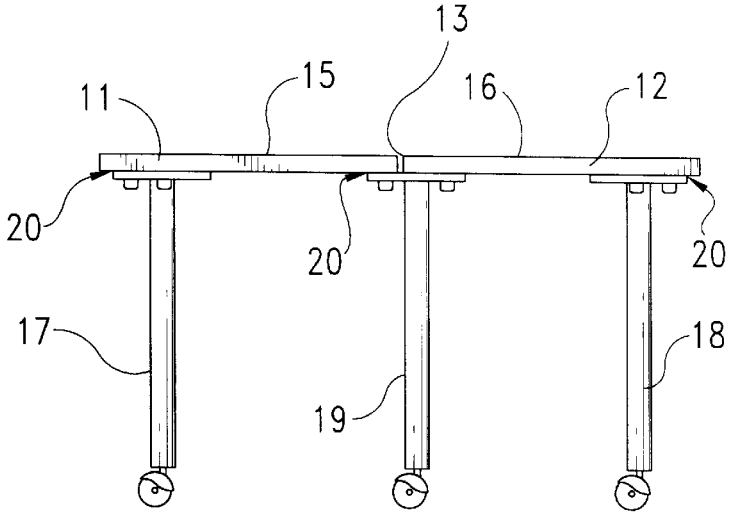
FIG. 2 is a side elevational view of the table combination shown in FIG. 1.
Figure 3:
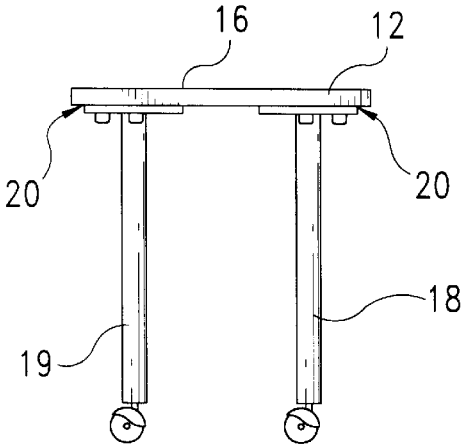
FIG. 3 is a side elevational view showing one of the tables of the table combination shown in FIGS. 1 and 2, with the convertible table leg apparatus disposed underneath and supporting the single table.

Shown in FIG. 2, each of the leg assemblies 17, 18, and 19, are connected to a respective tabletop 15, 16, by way of an attachment assembly 20. The attachment assembly 20 for each of the legs 17 and 18 is disposed wholly beneath a corresponding one of the tabletops 15, 16. The attachment assembly 20 for the common leg assembly 19, however, spans between the two tables and across the joint 13. As depicted in FIG. 2, the attachment assembly 20 for the convertible leg apparatus is in its extended or ganging position. Alternatively, the attachment assembly 20 can be retracted to its initial position completely underneath a single table. Thus, as shown in FIG. 3, both legs 18 and 19 are disposed wholly beneath table 12. Likewise, each attachment assembly 20 is disposed completely underneath the tabletop 16.

Figure 7:
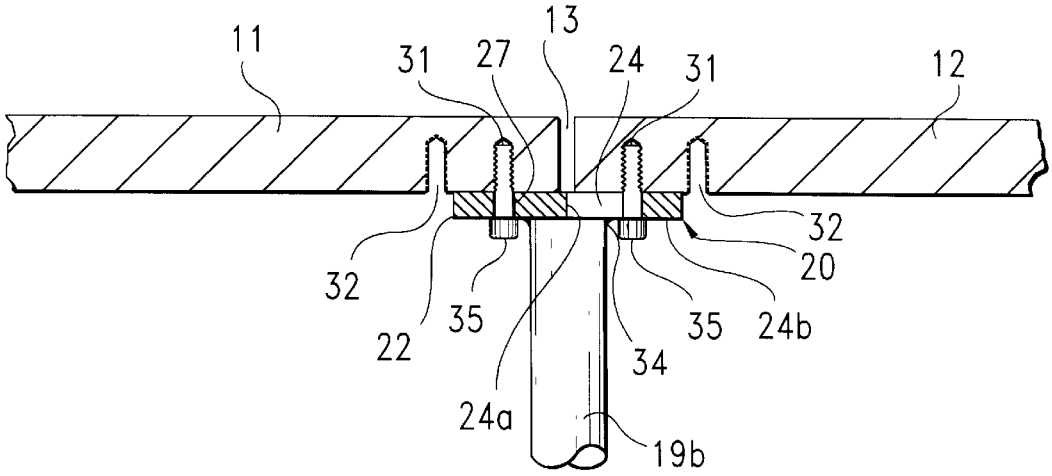
FIG. 7 is a side cross sectional view of the table combination and attachment assembly depicted in FIG. 6.

Referring now to FIG. 4, details of the attachment assembly 20 can be discerned. In particular, the attachment assembly 20 includes a plate 22 that is elongated to span a distance at least equal to the space between the posts of the common leg assembly 19. In particular, the common leg assembly 19 includes leg posts 19*a* and 19*b* that are disposed apart and interconnected by a horizontal member 19*c*. Preferably, the leg posts 19*a* and 19*b* are separated by a distance that is approximately equal to the width of the tabletop for each of the tables 11, 12 to provide adequate support for the ends of the table. The leg posts 19*a* and 19*b*, together with the horizontal member 19*c*, assume the form of an "H" shape for maximum support of the tables. The plate 22 of the attachment assembly 20 then, is mounted to one end of each of the leg posts 19*a* and 19*b*, such as a weld 35 as depicted in FIG. 7.

As depicted in FIG. 4, the leg posts 19*a* and 19*b* are attached to the plate 22 adjacent the opposite ends of the plate. The plate 22 defines a pair of elongated slots 24 and 25, respectively, that are disposed between the leg posts 19*a* and 19*b*. Preferably, each of the slots 24 and 25 is situated equidistant from a central transverse axis of the plate 22 passing between the leg post 19*a* and 19*b*. In accordance with the present invention, the slots 24 and 25 are elongated along an axis that is perpendicular to an axis defined between the leg posts 19*a* and 19*b* (or parallel to the central transverse axis). Put in other terms, the two slots 24 and 25 are elongated between the opposite long edges 22*a* and 22*b* and with plate 22. Furthermore, the slots 24 and 25 are substantially parallel so that the plate 22 can be linearly translated when fasteners are disposed in each corresponding slot.

In addition to the two slots 24 and 25, the plate 22 further defines a pair of apertures 27 and 28. The apertures are preferably circular, and only slightly larger than a fastener passing therethrough. In accordance with the present invention, the apertures 27 and 28 fall along the parallel axes passing through the pair of slots. Moreover, the apertures 27 and 28 are situated between the end of the ends 24*a* and 25*a* of the two slots and the long edge 22*a* of the plate 22.

The plate 22 can also define an array of screw holes 29 at the interior of the plate between the two slots 24 and 25. The screw holes 29 can be used to receive screws that directly and substantially permanently fasten the plate 22 to a particular tabletop. For instance, an attachment assembly of one of the outer leg assemblies 17 or 18 may be permanently attached to one of the tabletops 15, 16.

Figure 6:
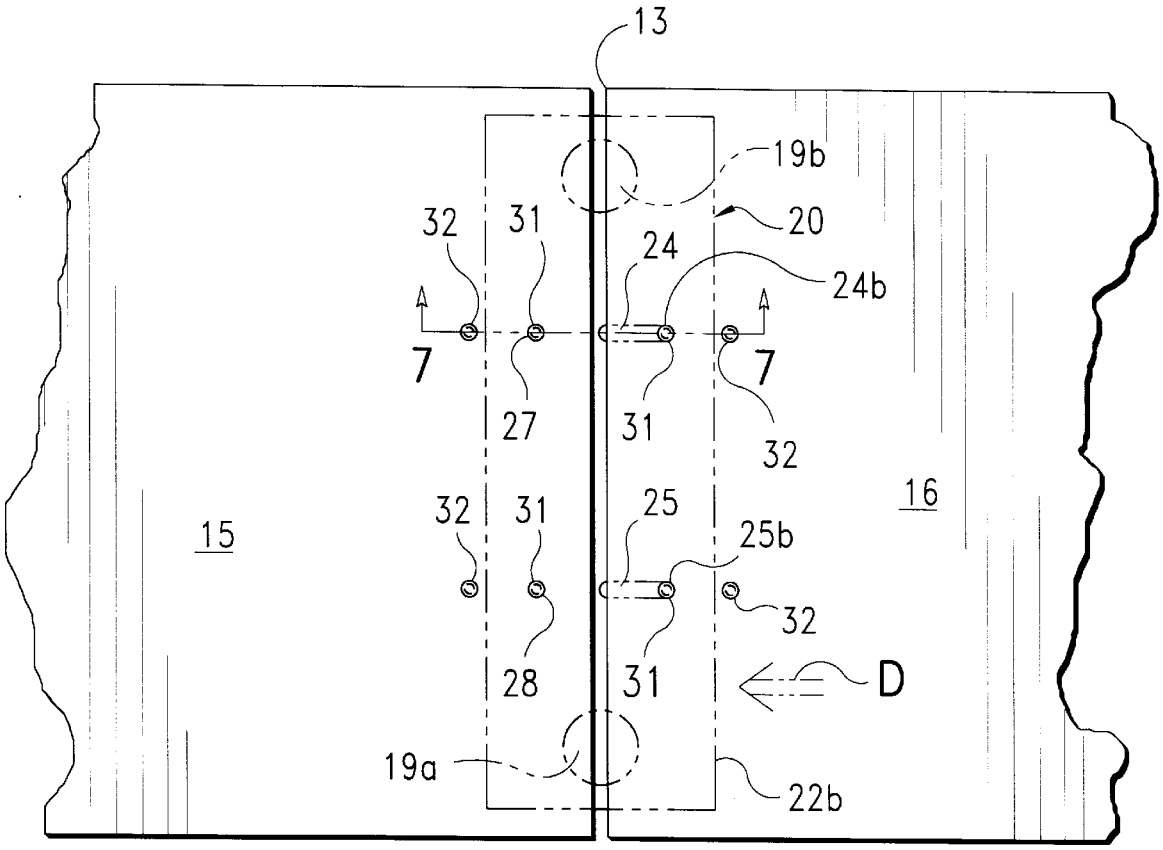
FIG. 6 is a view from underneath the table combination of FIG. 5 with the attachment assembly in its second position interconnecting the adjacent tables and providing support for the tables.

The convertible positions of the attachment assembly 20 are depicted in FIGS. 5–7. Looking first at FIG. 5, the attachment assembly 20 is illustrated in its initial position disposed entirely under a single tabletop 16. The attachment assembly 20 is depicted in phantom lines in order to permit clearer illustration of the threaded bores in the underside of each of the tabletops 15 and 16. In particular, in accordance with one aspect of the present invention, all of the tabletops can have the same arrangement of threaded bores as depicted in FIG. 5. This arrangement can include a first pair of outboard threaded bores 31 and a second pair of inboard threaded bores 32. Each bore 31 and 32 of the two pairs is aligned along common parallel axes. These axes are disposed apart the same distance as the slots 24 and 25 in the plate 22. As can be seen in FIG. 5, the tabletop 15 includes a similar grouping of threaded bores 31 and 32. Each of the threaded board is configured to receive an elongated threaded fastener therein for tightening an attachment assembly 20 to the tabletop.

In FIG. 1, the plate 22 is shown in its first retracted position in which its long edge 22*a* is recessed inboard from the joint 13 between the adjacent tabletops. In this orientation, each of the apertures 27 and 28 is aligned with a corresponding one of the inboard threaded bores 31. As so aligned, a threaded fastener can extend through the apertures 27, 28 for engagement within the outboard threaded bores 31. Similarly, each of the inboard threaded bores 32 is oriented in alignment with a corresponding slot 24, 25. Preferably, the inboard threaded bores 32 are directly aligned with the outboard end 24*a*, 25*a* of each of the slots 24, 25. In this position, the leg posts 19*a* and 19*b*, and more specifically the common leg assembly 19, is completely disposed underneath and supporting only one tabletop, namely tabletop 16.

Referring now to FIGS. 6 and 7, the attachment assembly 20 can be linearly translated in the direction of the arrow D. In order to achieve this translation, the fastener initially passing through the apertures 27, 28 into the outboard threaded bores 31 of tabletop 16 is removed. The threaded fastener extending through each of the slots 24, 25 and into a corresponding inboard threaded bore 32 of tabletop 16 is likewise removed. The attachment assembly 20 is then linearly translated toward the other tabletop 15 so that the plate 22 bridges the joint 13 between the two tabletops. In this position, the apertures 27, 28 are aligned with the outboard threaded bores 31 of the second tabletop 15.

Similarly, the slots 24, 25 are aligned with the outboard threaded bores 31 of the first tabletop 16. Most specifically, the outboard threaded bores 31 of tabletop 16 are aligned with the second ends 24*a*, 25*a* of the respective slots. The same threaded fasteners can be passed through the apertures 27, 28 and slots 24, 25 and engaged within the two sets of outboard threaded bores 31, once set in tabletop 16 and the other set in tabletop 15.

As shown in FIG. 7, the threaded fasteners can constitute thumbscrews 35 having threaded stems that are sized to pass freely through the slots 24, 25 and apertures 27, 28. The threaded stem of each thumbscrew 35 is then threaded into a corresponding outboard threaded bore 31 to firmly clamp the plate 22, and therefore the attachment assembly 20, to each of the tables 11 and 12. Preferably, the slots 24 and 25 are configured so that the joint 13 yields a negligible gap, most preferably with the edges of the tables 11, 12 directly abutting.

The embodiment shown in FIGS. 5–7 is preferably limited to use as a common leg assembly, such as leg assembly 19, rather than as an end leg assembly, such as leg assemblies 17 or 18. With this limitation, the attachment assembly 20 can be situated with the slots 24, 25 aligned with the outboard fastener bores 31 of the tabletop 16. With this arrangement, the threaded fasteners 35 passing through the slots 24, 25 need not be removed, but simply loosened to allow the plate 22 to be translated toward the second tabletop 15.

As an alternative, the slots 24, 25 can be longer in the inboard direction. If the slots are sufficiently long, the plate 22 can be translated with the fastener 35 engaged loosely within the inboard fastener bores 32. Referring to FIG. 6 it can be seen that the inboard end 24*b*, 25*b* of the slots would be extended in alignment with the inboard bores 32. Likewise, the inboard long edge 22*b* of the plate 22 would also be extended inboard of the bores 32.

A further modification to this embodiment involves relocating the outboard fastener bores. As depicted in phantom in FIG. 5, the outboard bores 31 can be oriented at a position 31' immediately adjacent the edge of the tabletop 15. In this position, and with the two tabletops abutting, the plate 22 can be translated to a position in which the apertures 27, 28 are aligned with the bores 31'. The slots 24, 25 remain aligned with the inboard bores 32 of the first tabletop 16, and particularly with the inboard ends 24*b*, 25*b* of the slots.

With this latter modification, an additional set of fastener bores must be formed in the tabletops in order to maintain interchangeability of the tabletops. Alternatively, some tabletops can include only the modified fastener bores 31', while other tabletops include the normal complement of bores 31, 32.

This detriment is addressed in the embodiment shown in FIGS. 8–11. The embodiment in these figures involves a modification to the plate of the attachment assembly, as well as a reorientation of the threaded bores within the tabletops 15 and 16. In this embodiment, and attachment plate assembly 60 includes a plate 62, as illustrated in FIG. 8. The plate 62 includes the parallel elongated slots 64 and 65, as well as the individual apertures 67 and 68. In this embodiment, the leg posts 19*a* and 19*b* are affixed to the plate 22 in a manner similar to that described above. The plate 62 can also include the plurality of screw holes 69 to permit substantially permanent fixation of the plate 62 to one of the tabletops.

In this embodiment, the plate 62 is modified so that its long edge 62*a* is closer to the pair of apertures 67, 68 than the edge 22*a* of the plate 22 shown in FIG. 4. One benefit of this modification can be seen with reference to FIGS. 9–11. In FIG. 9, the attachment assembly 60 is illustrated in its first or retracted position stored under a single table, such as tabletop 16. The tabletop 16 includes the pair of outboard threaded bores 31 and inboard threaded bores 32, However, these bores can be oriented closer to the edge of the table than in the previous embodiment depicted in FIG. 5. This orientation of the threaded bores in the tabletop 16 is made possible because the long edge 62*a* of the plate 62 is closer to the aperture 67, 68. As shown in FIG. 9, with the attachment assembly 60 in its retracted position, the apertures 67, 68 are aligned with the outboard threaded bores 31 of the tabletop 16. Moreover, the inboard threaded bores 32 are aligned with the ends 64*a*, 65*a* of the respective slots 64, 65.

Figure 10:
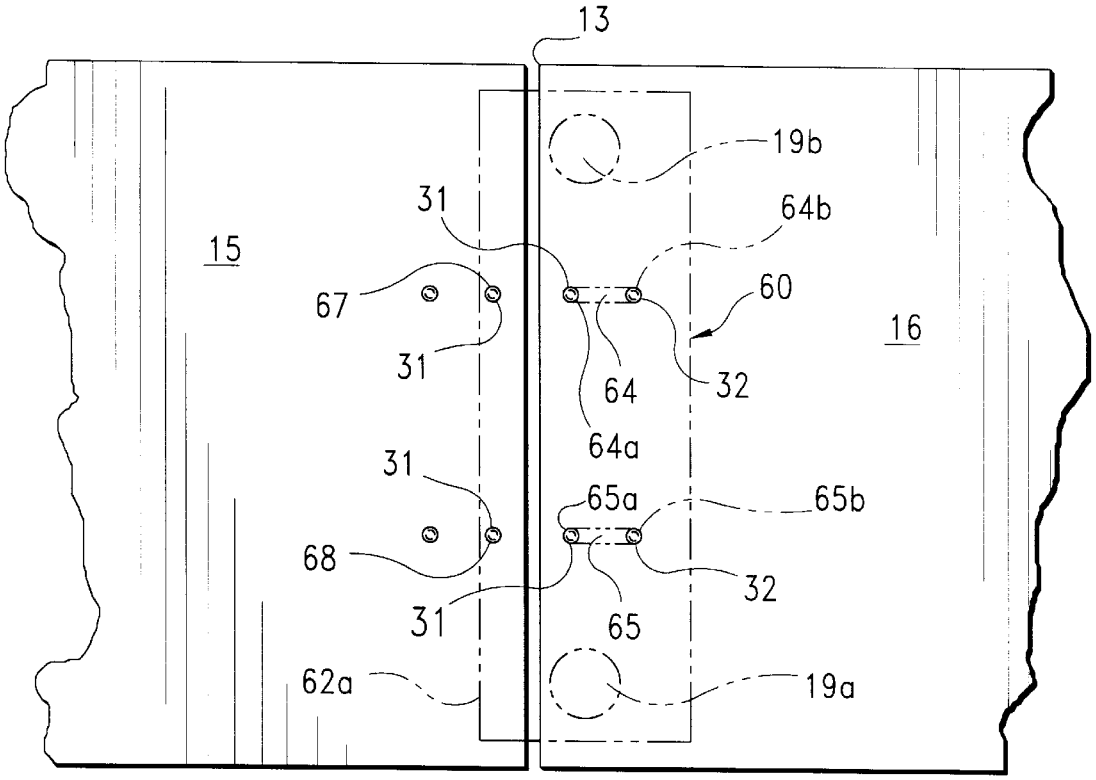
FIG. 10 is a view from the bottom of the table combination shown in FIG. 9 with the attachment assembly in its second position interconnecting the adjacent tables and providing support for the tables.
Figure 11:
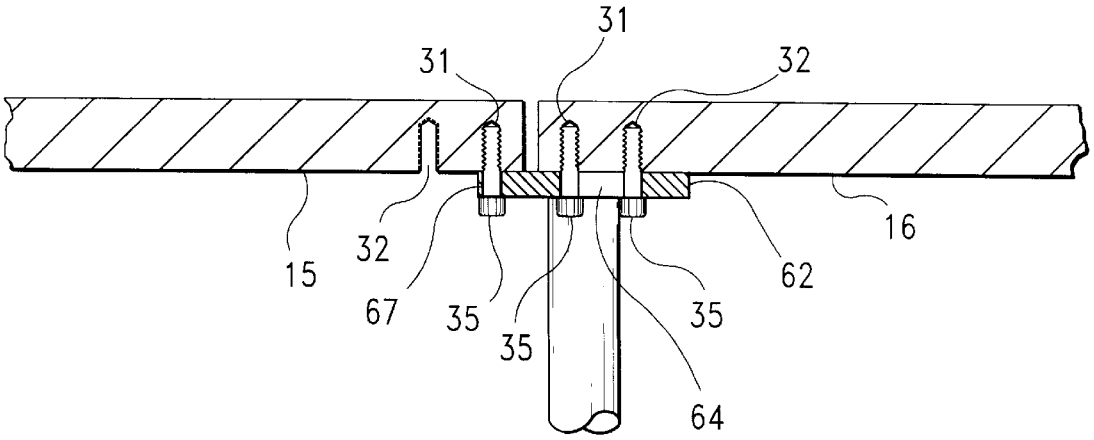
FIG. 11 is a side cross sectional view of the table combination and attachment assembly depicted in FIG. 10.

Looking now at FIG. 10, the attachment assembly 60 is shown translated to a second position in which the assembly spans the joint 13 between the tabletops 15 and 16. In this position, the apertures 67, 68 are aligned with the outboard threaded bores 31 of the other tabletop 15. In one feature of this embodiment, the inboard threaded bores 32 of the first tabletop 16 are aligned with the inboard ends 64*b*, 65*b* of the slots 64 and 65, respectively. In addition, the outboard threaded bores 31 of the tabletop 16 are aligned with the opposite ends 64*a*, 65*a* of the two slots 64, 65. Thus, the slots 64 and 65 are oriented so that the fasteners can be engaged at the opposite ends of the slots, to enhance the fixation, as shown most clearly in FIG. 11. With this embodiment, three thumbscrews 35 pass through the plate 62, with one thumbscrew passing through the aperture 67, and two thumbscrews passing through the slot 64. Two of the thumbscrews can engage the corresponding inboard and outboard threaded bores 31, 32 of tabletop 16, while the third thumbscrew engages the outboard threaded bore 31 of the second tabletop 17.

The embodiment of the attachment assembly 20 depicted in FIGS. 8–11 provides the advantage that the thumbscrews engaged within the inboard threaded bores 32 need not be removed to permit translation of the attachment assembly 60 from its first to its second position. As can be seen by a comparison of FIGS. 9 and 10, a thumbscrew engaged within the inboard threaded bores 32 of the tabletop 16 can be simply loosened, thereby allowing the plate 62 to slide toward the other tabletop 17, with the thumbscrews 35 acting as a guide. Once the thumbscrews 35 contact the inboard ends 64*b*, 65*b* of the slots 64, 65, the attachment assembly 60 stops its translation. The thumbscrews 35 oriented at the inboard ends 64*b*, 65*b* of the slots can then be tightened.

A second thumbscrew 35 can be inserted into the outboard threaded bores 31 of the first tabletop 16 at the opposite ends of 64*a*, 65*a* of the slots. Finally, the last set of thumbscrews 35 can be extended through the apertures 67, 68 in the plate 62, and engaged within the outboard threaded bores 31 of the tabletop 15. With this embodiment, since two parallel slots 64 and 65 are utilized, the thumbscrews 35 extending through the slots help facilitate the lateral translation of the attachment assembly 20 from its retracted position underneath one tabletop 16 to its extended position beneath both tabletops 15 and 16. Again, it is understood that while the joint 13 is depicted as including a gap, it is desirable that the adjacent tabletops 15, 16 be abutting. The outboard and inboard threaded bores 31, 32, respectively, of each tabletop are appropriately oriented to achieve this juxtaposition of the tabletops.

The same principles of the embodiments shown in FIGS. 1–11, namely the parallel slots and individual apertures, can be applied to a single post leg. For example, an attachment assembly 40 shown in FIG. 12 includes a plate 42 to which a single post leg 43 is attached. The plate 42 also defines parallel slots 44 and 45 and apertures 47 and 48, which are configured similar to the like components of the plates 22 or 62 shown in the prior figures. With this particular embodiment, it is not anticipated that the plate 42 of the attachment assembly 40 will have an elongated length spanning the entire width of the tabletop. Instead, since the attachment assembly 40 accommodates a single post leg 43, the length of the plate can be limited to less than half the width of a tabletop. With this single post embodiment, it is contemplated that at least three such attachment assemblies 40 would be associated with a single free-standing table. For a pair of connected tables, such as tables 11 and 12, a minimum of five such attachment assemblies 40 can be utilized. Two attachment assemblies can be situated at the opposite free ends of the two tables and a single attachment assembly can disposed at the joint between the two tables.

Figure 13:
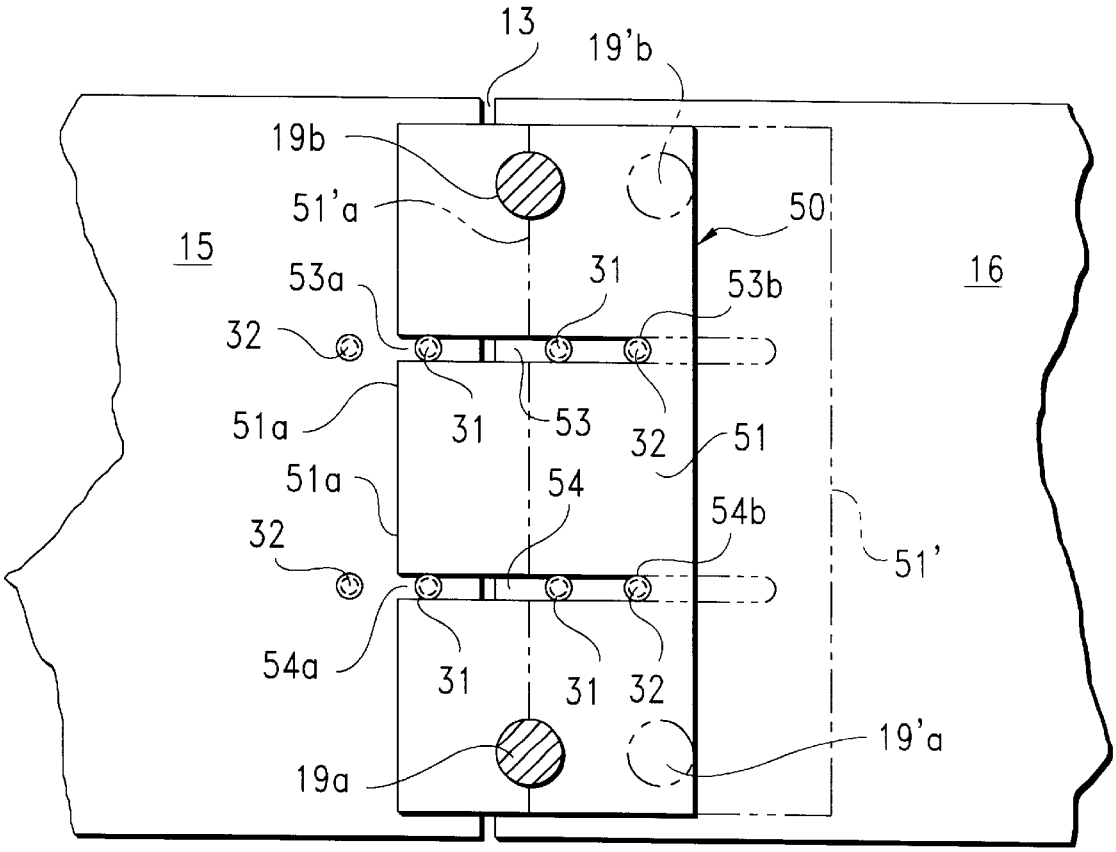
FIG. 13 is a view from the bottom of a table combination, such as shown in FIGS. 1 and 2, with an attachment assembly according to a further embodiment of the invention, in which the attachment assembly is shown in phantom lines in its first position underneath a single table and in solid lines in its second position spanning adjacent tables.

In a further embodiment of the invention, an attachment assembly 50 shown in FIG. 13 includes a plate 51 that accommodates the posts 19*a* and 19*b* of a dual-post table leg. With this embodiment, the plate 52 defines a single pair of parallel slots 53 and 54 that extend from an inboard position all the way to the long edge 51*a* of the plate 51. In other words, each of the slots includes an open end 53*a*, 54*a* at the long edge 51*a* of the plate 51. The opposite ends 53*b*, 54*b* of the slots are inboard and are always positioned beneath a single tabletop, such as tabletop 16. As shown in FIG. 13, the plate can have its retracted position as shown by the phantom lines 51' in which the leg posts 19'*b* and 19'*a* are disposed wholly beneath tabletop 16 and the plate itself is retracted so that its long edge 51'*a* is inboard from the joint 13.

In its extended position, the slots 53 and 54 span the inboard threaded bores 32 of tabletop 16 and both of the outboard threaded bores 31 of the tabletops 15 and 16. With this slot configuration, the requirements for aligning an aperture in the plate with one of the outboard threaded bores 31 of the tabletop 15, is eliminated. Thus, the slots 53 and 54 allow thumbscrews to be positioned within all of the threaded bores and simply loosened to accommodate translation of the plate from its stowed position 51' to its extended position 51. In a further feature of the embodiments shown in FIGS. 8–11 and in FIG. 13, the translation of the corresponding attachment assemblies 60 and 50 maintain the leg posts 19*a* and 19*b* beneath one table, such as table 16, whether the assembly is in its retracted or extended position. As shown most clearly in FIG. 13, the leg posts can have the stowed or retracted position 19'*a* and 19'*b*, or the extended position 19*a*, 19*b*. In both cases, however, the leg posts are solely beneath tabletop 16. With this arrangement, greater clearance beneath other tabletop 15 is provided, since only one leg assembly, or set of legs, need be oriented under that tabletop. The attachment assemblies 50 and 60 can allow the user to vary the space underneath a tabletop, such as for leg room or other purposes.

In the preferred embodiment, the plates for each of the attachment assemblies is formed from a hot rolled steel plate. In one specific embodiment, the plates have a thickness of 0.25 inches. In a further specific embodiment, the parallel slots, such as slots 24, 25, have a width of about 0.44 inches and a length of about 1.75 inches. The apertures, such as apertures 27, 28 can have a diameter of 0.44 inches, in the same specific embodiment. With these embodiments, the threaded fastener, such as thumbscrew 35, must have an outer diameter that is less than the 0.44 inch slot width or aperture diameter. Preferably, the threaded fastener is sized to maintain a clearance of 0.02 inches around the shank of the fastener. It is understood that the threaded fastener, such as threaded fastener 35, can have a variety of configurations, including the thumbscrew configuration depicted in the figures. Alternatively, the fastener can be in the style of a wing-type screw, a hex-head, or an internal hex-head. In addition, the fastener can have a non-threaded portion of the shank that passes through the slots and apertures in the plates of the attachment assemblies. As a further alternative, the fastener can include a shank that is embedded within the tabletops at the location of the bores 31, 32. This alternative approach is useful with the embodiment of the convertible leg assembly shown in FIG. 13, since the open-ended slots will accommodate the downwardly extending shanks of the embedded fasteners. In this instance, the fastener would also include a threaded nut for engaging the fastener and clamping the corresponding plate, such as plate 51, to the tabletop.

As indicated previously, for a double-post leg assembly, the plates can be elongated to essentially span the width of a tabletop. Of course, this dimension can be reduced, depending upon the configuration of the leg assembly. In one specific embodiment, the individual leg posts 19*a* and 19*b* of a leg assembly are about 15.0 inches apart on center. Thus, the attachment plate can have an elongated length of about 18.0 inches, in this specific embodiment.

In the embodiments for the double-post leg assemblies, the parallel slots, such as slots 24, 25, and the pair of apertures, such as apertures 27, 25, are uniformly disposed between the leg posts. The arrangement of the slots and apertures relative to the leg posts can be revised to provide the greatest and most uniform support for the attachment assemblies to the corresponding tabletops. In addition, the orientation of the slots and apertures can be dictated by ease of access for positioning the threaded fasteners through the corresponding slots and apertures.

In one specific embodiment, the parallel slots and apertures are situated about 4.0 inches inboard of the center line for the leg posts 19*a* and 19*b*. The parallel slots are themselves spaced about 6.5 inches apart in the specific embodiment to provide as wide a fixation track as possible. With this configuration, the attachment assemblies are not prone to shifting or wobbling as they are translated from their retracted to their extended positions.

Figure 12:
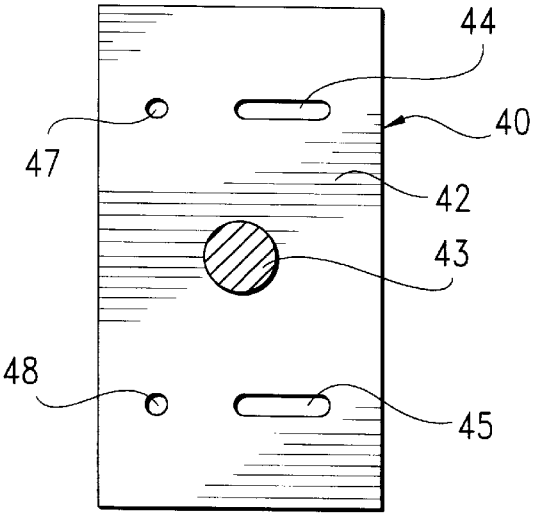
FIG. 12 is a top elevational view of an attachment assembly according to yet another embodiment of the invention for use with a single post leg.

In the single post embodiment of FIG. 12, the parallel slots and apertures straddle the single post 43. Again, preferably the slots and apertures are positioned for ease of access and for optimal stability. Thus, in a specific embodiment, the parallel slots are situated about 3.5 inches away from the centerline of the single leg post 43.

In the illustrated embodiments, the apertures and slots are situated along a common axis. Alternatively, the apertures, such as apertures 27, 28 or 67, 68, can be offset from alignment with the corresponding slots 24, 25 or 64, 65. Corresponding changes to the pattern of threaded bores, namely bores 31, in the tabletops can be made to align with the position of the apertures.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

What is claimed is:

1. A convertible leg apparatus for interconnecting and supporting adjacent articles of furniture, each article of furniture having a substantially planar surface, the apparatus comprising:

a plate having an edge, said plate defining;

at least two elongated slots, each of said slots having a longitudinal axis, said axis of each of said slots being mutually parallel and substantially perpendicular to said edge; and at least two apertures corresponding to said at least two elongated slots, each of said apertures being disposed between a corresponding one of said at least two slots and said edge and aligned with said longitudinal axis of said corresponding one of said slots;

a leg member affixed to and extending substantially perpendicularly outward from said plate, wherein said leg member includes a pair of leg posts straddling said at least two slots; and at least four fasteners sized to extend through said slots and said apertures and configured to removably engage the substantially planar surface of the articles of furniture.

2. The convertible leg apparatus according to claim 1, wherein said pair of leg posts define an axis therebetween, said axis intersecting said at least two slots.

3. The convertible leg apparatus according to claim 1, wherein said at least four fasteners are screws having a threaded shank configured for threaded engagement within threaded bores defined in the planar surface of the articles of furniture.

4. The convertible leg apparatus according to claim 3, wherein said screws include an enlarged head configured for manual tightening of said screws within the threaded bores.

5. A table combination comprising:

a first table having a first tabletop and defining at least two first spaced apart outboard threaded bores and at least two first spaced apart inboard threaded bores in a pattern on the underside of said first tabletop, said first tabletop having a free end and a ganging end;

a second table having a second tabletop and defining at least two second spaced apart outboard threaded bores and at least two second spaced apart inboard threaded bores in said pattern on the underside of said second tabletop, said second tabletop having a free end and a ganging end, said ganging ends of said first and second tabletops being in abutting relationship;

an outer leg member disposed at said free end of each of said first and second tabletops; and a convertible leg apparatus including;

a plate having an edge adjacent said ganging end of said first tabletop, said plate defining;

at least two elongated slots, said slots having mutually parallel longitudinal axes substantially perpendicular to said edge, said slots being spaced apart so that said slots are aligned with said first inboard bores in said first tabletop; and two apertures disposed between said two slots and said edge and spaced apart so that said at least two apertures are aligned with said first outboard bores in said first tabletop when said at least two slots are aligned with said first inboard bores;

a leg member affixed to and extending substantially perpendicularly outward from said plate, wherein said leg member includes a pair of leg posts straddling said at least two slots; and at least four fasteners sized to extend through said at least two slots and said at least two apertures and configured to be removably engaged within said first inboard bores of said first tabletop and outboard bores of said first and second tabletops.

6. The table combination according to claim 5, wherein said pair of leg posts define an axis therebetween, said axis intersecting said two slots.

7. The convertible leg apparatus according to claim 5, wherein said leg member is a single post leg affixed to said plate between said two slots.

8. The table combination according to claim 5, wherein said at least four fasteners are screws having a threaded shank configured for threaded engagement within said bores.

9. The table combination according to claim 8, wherein said screws include an enlarged head configured for manual tightening of said screws within the threaded bores.

10. The table combination according to claim 5, wherein each of said at least two elongated slots has a length along said mutually parallel axes that is at least equal to the distance between said first inboard bores and said first outboard bores.

11. A convertible leg apparatus for interconnecting and supporting adjacent articles of furniture, each article of furniture having a substantially planar surface, the apparatus comprising:

a plate having an edge, said plate defining;

at least two elongated slots, each of said slots having a longitudinal axis, said axis of each of said slots being mutually parallel and substantially perpendicular to said edge, each of said slots opening at said edge; and a dual post leg member affixed to and extending substantially perpendicularly outward from said plate, said leg member having a pair of leg posts straddling said at least two slots; and at least four fasteners sized to extend through said slots and said apertures and configured to removably engage the substantially planar surface of the articles of furniture.

* * * * *

UNITED STATES PATENT AND TRADEMARK OFFICE

CERTIFICATE OF CORRECTION

PATENT NO. : 5,988,077

DATED : Nov. 23, 1999

INVENTOR(S) : Nicola Balderi

It is certified that error appears in the above-identified patent and that said Letters Patent is hereby corrected as shown below:

Col. 4, line 22
replace "its position"
with --its first position--

Signed and Sealed this

Twenty-fifth Day of July, 2000

*Attest:*

*Attesting Officer*

Q. TODD DICKINSON

*Director of Patents and Trademarks*